US005476192A

United States Patent [19]

Julinot

[11] Patent Number: 5,476,192

[45] Date of Patent: Dec. 19, 1995

[54] SELF-DEFENSE DEVICE

[76] Inventor: Helmut Julinot, 860 Cottage Hill Ave., Mobile, Ala. 36693

[21] Appl. No.: 226,838

[22] Filed: Apr. 13, 1994

Related U.S. Application Data

[63] Continuation-in-part of Ser. No. 69,446, May 27, 1993, Pat. No. 5,310,086.

[51] Int. Cl.[6] ..... B67D 5/32

[52] U.S. Cl. ..... 222/78; 116/81; 116/DIG. 44; 222/153.13; 222/182; 222/192; 222/402.11

[58] Field of Search ..... 222/39, 78, 153, 222/175, 182, 183, 184, 192, 402.11, 402.15; 116/2, 77, 81, DIG. 44

[56] References Cited

U.S. PATENT DOCUMENTS

| | | | |
|---|---|---|---|
| 2,914,222 | 11/1959 | Meshberg | 222/162 |
| 3,729,119 | 4/1973 | Sette et al. | 222/153 |
| 3,754,689 | 8/1973 | Blank | 222/402.11 |
| 3,788,523 | 1/1974 | Thomas | 222/153 |
| 3,934,761 | 1/1976 | Gentreau | 222/183 |
| 4,044,712 | 8/1977 | Goodman et al. | 116/DIG. 44 X |
| 4,044,922 | 8/1977 | Bordelon | 222/183 |
| 4,098,436 | 7/1978 | Kohlbeck | 222/182 |
| 4,226,339 | 10/1980 | Landsman et al. | 222/182 |
| 4,434,914 | 3/1984 | Meshberg | 222/153 |
| 4,449,474 | 5/1984 | Mariol | 116/DIG. 44 X |
| 4,572,410 | 2/1986 | Brunet | 222/402.11 |
| 4,678,106 | 7/1987 | Newell et al. | 222/162 |
| 4,759,309 | 7/1988 | Zediker | 222/39 X |
| 4,776,491 | 10/1988 | Nitta | 222/153 |
| 4,799,877 | 1/1989 | Bisbee | 431/153 |
| 4,982,522 | 1/1991 | Norton | 42/85 |
| 5,289,164 | 2/1994 | Novak | 116/DIG. 44 X |
| 5,310,086 | 5/1994 | Julinot | 222/153 X |
| 5,325,997 | 7/1994 | Washington et al. | 222/192 X |
| 5,332,119 | 7/1994 | Davis | 222/192 X |
| 5,358,144 | 10/1994 | Mock | 222/39 X |

*Primary Examiner*—Andres Kashnikow
*Assistant Examiner*—Joseph A. Kaufman
*Attorney, Agent, or Firm*—Jacobson, Price, Holman & Stern

[57] ABSTRACT

A self-defense device for use by a victim or intended victim of an attack or intended attack by an attacker and includes the use of an audible alarm and/or a disabling spray device which will discharge a disabling spray toward and onto the attacker. The audible alarm can be manually actuated by the victim or intended victim or automatically actuated if the self-defense device is pulled away from the victim by the attacker. The spray device is manually actuated. Automatic actuation of the audible alarm also disarms the spray device in response to the self-defense device being pulled away from the victim thereby preventing the attacker from using the disabling spray device to temporarily disable the victim. The self-defense device is incorporated into a housing structure which is simulative of an item normally carried by a person in their hand when walking, jogging, shopping and the like thereby disguising the device to prevent the attacker from becoming aware that the intended victim has a self-defense device in their possession. The housing of the self-defense device also includes an opening defining a window to enable observation of a canister of spray material incorporated into the housing to enable a determination to be made as to the character of the spray material to be discharged.

14 Claims, 4 Drawing Sheets

22
100
SURE SHOT 44
22
98
ON/OFF
AM FM
MODE
SET
FX Sports 22
96
SUPERBASS
POWERTONE
L
B
T 44
22
46
PHONE
CHAN
MUTE
TONE
OFF
RECORD/PAUSE
MESSAGES
POWER 164
162
166
150
148
158
168
160
152
154
156

140
142
146
144
154

132
134
112
118
110
116
122
124
128
130
136
114
120
126
108

104
106
102

SELF-DEFENSE DEVICE

CROSS REFERENCE TO RELATED APPLICATION

This application is a continuation-in-part of U.S. Ser. No. 08/069,446 filed May 27, 1993 for METHOD AND APPARATUS FOR AUTOMATICALLY DISARMING SELF-DEFENSE SPRAY DEVICE now U.S. Pat. No. 5,310,086 issued May 10, 1994.

BACKGROUND OF THE INVENTION

1. Field of the Invention

The present invention generally relates to a self-defense device for use by a victim or intended victim of an attack or intended attack by an attacker and includes the use of an audible alarm and/or a disabling spray device which will discharge a disabling spray toward and onto the attacker. The audible alarm can be manually actuated by the victim or intended victim or automatically actuated if the self-defense device is pulled away from the victim by the attacker. The spray device is manually actuated. Automatic actuation of the audible alarm also disarms the spray device in response to the self-defense device being pulled away from the victim thereby preventing the attacker from using the disabling spray device to temporarily disable the victim. The self-defense device is incorporated into a housing structure which is simulative of an item normally carried by a person in their hand when walking, jogging, shopping and the like thereby disguising the device to prevent the attacker from becoming aware that the intended victim has a self-defense device in their possession. The housing of the self-defense device also includes an opening defining a window to enable observation of a canister of spray material incorporated into the housing to enable a determination to be made as to the character of the spray material to be discharged.

2. Description of the Prior Art

Recent increases in violent crimes committed against individuals who may walk, jog, shop or otherwise occupy somewhat isolated areas has produced a need for self-defense devices which would enable intended victims to deter and/or defend against physical attacks. As a result of such crimes, various self-defense devices have been developed for use by possible victims of violent crimes, law enforcement personnel and the like. Such devices include personal alarms which includes a small hand held housing, similar to a pager, having a loud siren or other audible alarm incorporated therein which can be actuated by an intended victim upon perceiving a potential attack. Other available devices include pressurized canisters of a disabling spray material such as "Mace" tear gas pepper spray and the like which will temporarily disable an attacker. However, spray devices can be grabbed by the attacker and taken away from the intended victim and used to temporarily disable the victim making completion of the crime by the attacker much easier.

The following U.S. patents are relevant to this invention.

| | |
|---|---|
| 2,914,222 | 4,226,339 |
| 3,729,119 | 4,434,914 |
| 3,754,689 | 4,572,410 |
| 3,788,523 | 4,678,106 |
| 3,934,761 | 4,776,491 |

-continued

| | |
|---|---|
| 4,044,922 | 4,799,877 |
| 4,098,436 | 4,982,522 |

While the above listed patents disclose various types of self-defense devices including safety devices for disabling spray devices, the prior art does not disclose the specific structural features and combinations incorporated into the present invention.

SUMMARY OF THE INVENTION

An object of the invention is to provide a self-defense device which simulates a readily recognizable object normally carried in hand held position without suspicion when observed.

Another object of the invention is to provide a self-defense device including a hand held housing in which a siren is mounted. The siren is manually actuated by a switch or automatically actuated when the housing is pulled away from an intended victim. The self-defense device also includes a disabling spray device that is manually actuated by the intended victim and automatically disarmed when the housing is pulled away from the victim to prevent an attacker from using the disabling spray on the victim.

A further object of the invention is to provide a self-defense device in accordance with the preceding objects in which the housing is provided with a window to enable a determination to be made as to the characteristics of the spray material to be discharged.

Still another object of the invention is to provide a self-defense device which simulates a readily recognizable object including but not limited to cellular phone, tape recorder, camera, radio, beach canister, folded umbrella, or hand weights or dumbbells. The recognizable object may be only an empty shell which provides the appearance of such an object or constructed to be functional where interior space permits. The objects are unobtrusive when carried in the hand when in public so that it is ready for immediate use in the event of an unexpected attack.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
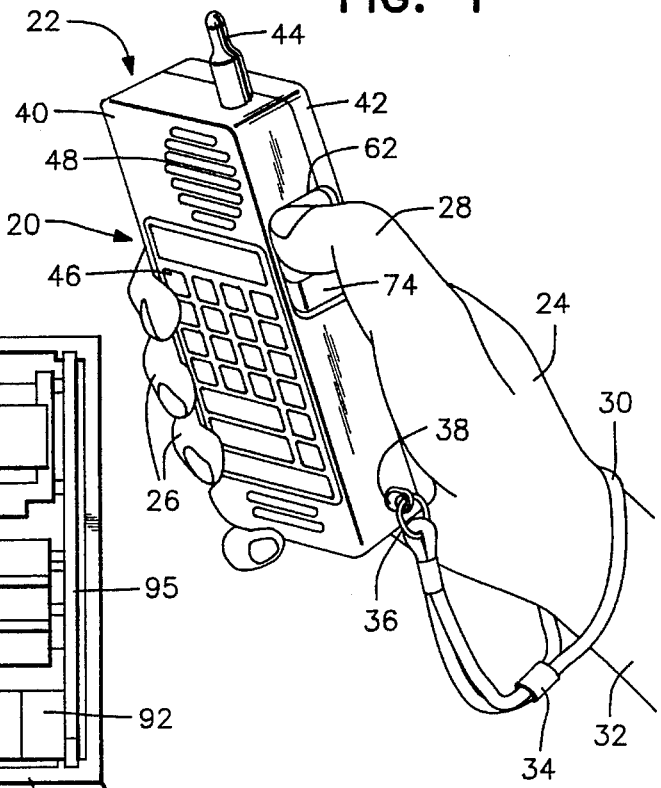
FIG. 1 is a perspective view of the self-defense device illustrating the association of the hand and wrist of a user with the device.

Referring to FIG. 1 of the drawings, the self-defense device of the present invention is generally designated by reference numeral 20 and is in the form of a generally rectangular housing 22 of a size to be conveniently carried in the hand 24 of a person using the device with the fingers 26 engaging one side edge of the housing and the thumb 28 being used to actuate the device and provide a firm grip to hold the device. The device includes a wrist strap 30 encircling the wrist area 32 and provided with a slide sleeve 34 to snug the wrist strap around the wrist with the other end of the wrist strap extending through and being secured to a ring 36 connected to a removable pin 38 which extends into the housing 22 for a purpose more specifically defined hereinafter.

The housing 22 includes a front hollow portion 40 and a removable back panel 42 which may be secured in position by screws or similar fastening devices. The upper end edge of the front hollow portion 40 of housing 22 is provided with a simulated antenna 44 which can be removed by moving it laterally out of a notch in the top wall of the housing. The front face of the front portion 40 is provided with indicia 46 which closely simulates the appearance characteristics of a cellular phone including areas which simulate the push buttons normally found on a cellular phone. The front face also includes a plurality of slot like openings 48 above the indicia 46 to facilitate high decibel sound passing therethrough which is produced by a siren 50 mounted interiorly of the front portion of the housing 22 above the indicia 46 on housing 22 as illustrated in FIG. 1.

Figure 2:
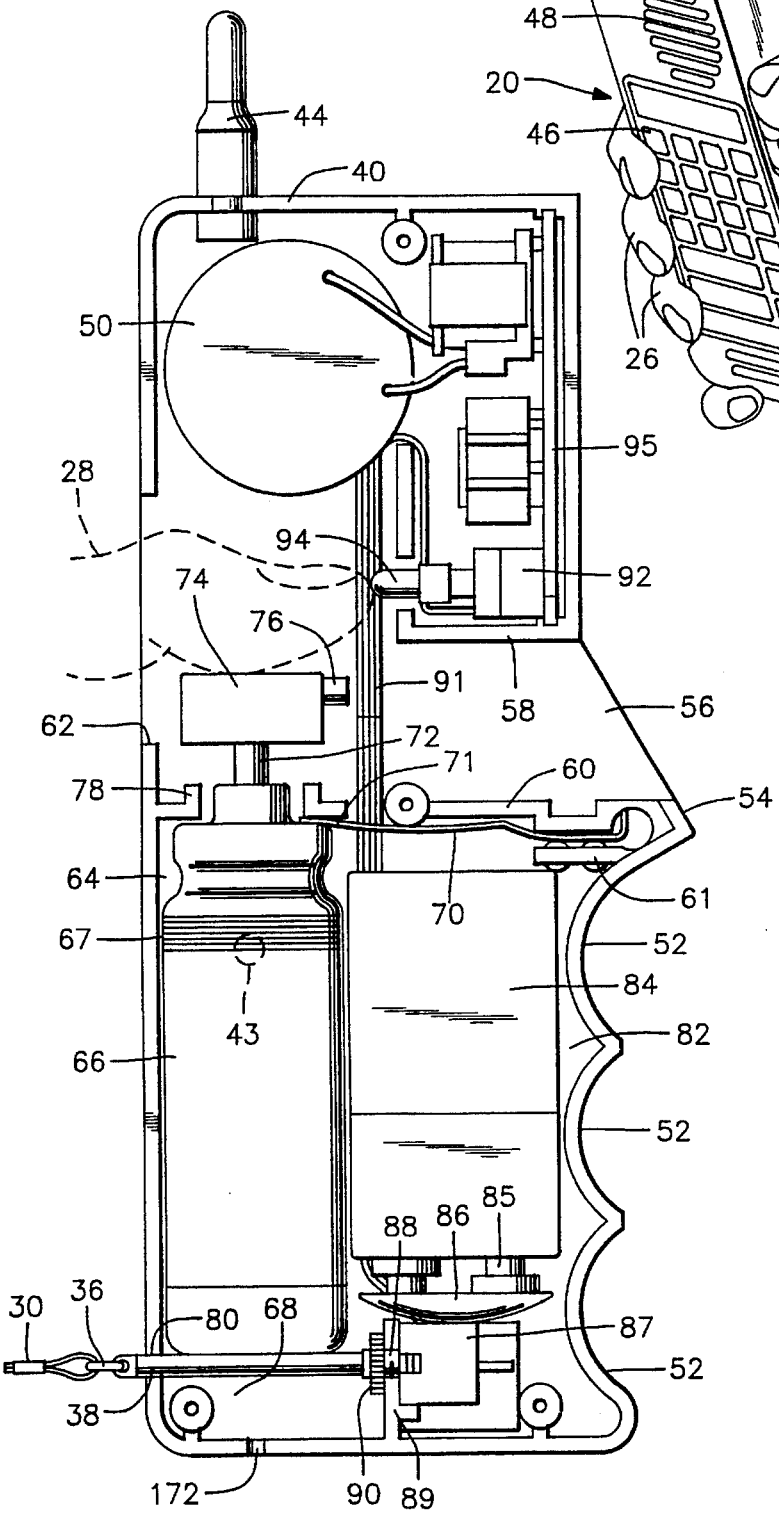
FIG. 2 is an elevational view of the device from the rear after the rear panel has been removed to illustrate the association of the components.
Figure 2A:
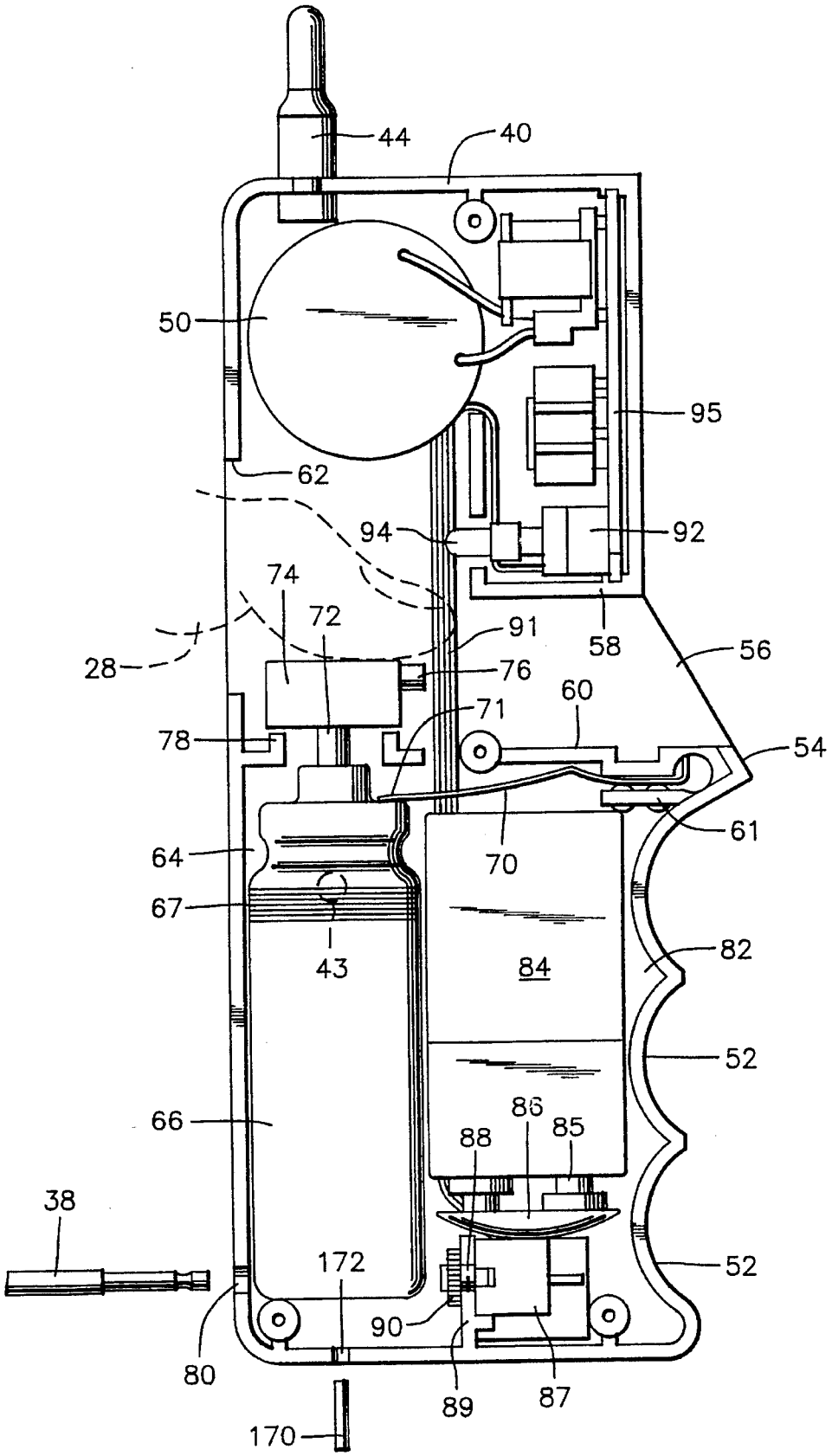
FIG. 2A is an elevational view, similar to FIG. 2, with a pin removed to automatically actuate a siren and automatically disarm a spray device.

As illustrated in FIGS. 2 and 2A, the edge of the housing 22 engaged by the fingers 26 is provided with a plurality of concave gripping areas 52 which receive three fingers with the small finger extending under the bottom of the housing 22 as illustrated in FIG. 1. Also, the edge of the housing 22 having the concave finger grip recesses 52 therein is provided with a projection forming an inclined edge portion 54 having an opening 56 formed by the front and rear walls of the housing 22 and vertically spaced, generally horizontal partial partition walls 58 and 60 formed on the front portion 40 of the housing 22. The opposite edge of the housing 22 is provided with an opening 62 which receives the thumb or finger 28 which is inserted therethrough as illustrated in FIG. 1 and as illustrated in broken lines in FIGS. 2 and 2A. Positioned below the opening 62 is a space 64 receiving a pressurized canister 66 of disabling spray material. The bottom end of the canister 66 is supported by the pin 38 when the pin is in the position illustrated in FIGS. 1 and 2. A space 68 is provided below the pin 38 which will enable the canister 66 to drop downwardly toward the bottom of the housing 22 When the pin 38 is removed. A leaf spring 70 is mounted in the housing between partition wall 60 and a support wall 61 formed on the front wall. The spring 70 includes a biased free end portion 71 which engages the upper end of the canister 66 to bias it downwardly. The upper end of the canister 66 is provided with a valve actuating discharge tube 72 extending into a rectangular, button type actuator 74 having a discharge nozzle 76 thereon directed toward the opening 56. By depressing the actuator 74 with the thumb 28, disabling spray will be discharged through the opening 56 as illustrated in FIG. 2. The upper end of the space 64 is provided with partial partitions 78 to retain the canister 66 in place with the transverse dimensions of the actuator 74 positioning the side walls of the actuator 74 adjacent the front and rear walls of the housing 22 in order to retain the nozzle 76 directed toward the opening 56. As illustrated in FIGS. 1 and 2, the disabling spray can be discharged manually by the use of the thumb 28 to depress the actuator 74. A person carrying the device appears to be carrying a cellular phone whereas, in fact, the person is carrying a spray dispenser that can be quite easily actuated and directed toward a potential attacker by the intended victim thereby temporarily disabling the attacker.

The pin 38 is retained in position by the spring biased canister 66 and by its engagement through an opening 80 in the side wall of the front portion 40 with the pin being retracted and removed in the event an attacker grabs the self-defense device 20 and pulls it away from the intended victim due to the wrist strap 30 encircling the wrist causing the pin to be removed. Removal of the pin 38 enables the spring 70 to displace the canister 66 downwardly in order that the actuator 74 comes into contact with and is supported by the partitions 78. This prevents the attacker from pushing the actuator 74 downwardly since there is no support for the canister 66. This prevents the spray being discharged toward the intended victim which would enable the attacker to more easily commit the intended physical violence.

The housing 22 also includes a space 82 continuous with the space 64 to receive a battery 84 to power the siren 50. The battery 84 includes terminals 85 having a connector assembly 86 connected to a miniature microphone socket 87 which energizes the siren 50 when the pin 38 is pulled outwardly from the microphone socket 87 thereby completing an electrical power circuit to the siren 50. The socket 87 includes a threaded hollow tube 88 extending through a notched plate 89 on housing 22 which receives a knurled or serrated retaining nut 90. Thus, when the pin 38 is pulled out of the housing such as when the attacker grabs the device and pulls it away from the victim, the siren will be automatically actuated and will continue to produce a very loud alarm signal until the pin 38 is reinserted.

The battery 84 and connector assembly 86 are also electrically connected to the siren 50 through conductors 91 and a manually actuated push on, push off switch 92 provided with a horizontally disposed actuating button 94 positioned above and generally in alignment with the inner end portion of the spray actuator 74 and the nozzle 76 in order for the inner end of the thumb or finger 28 to engage and push the switch actuating button 94 inwardly to close the switch 92 and manually operate the siren 50. The switch 92 and associated circuit components to actuate the siren are mounted on a removable circuit board 95.

The self-defense device is provided with either a manually operated siren or an automatically operated siren. In addition, the self-defense device may include the siren and disabling spray device both of which are manually actuated. Also, the siren can be automatically actuated and the spray device automatically disarmed when the device is pulled away from the wrist of the intended victim which will cause the pin 38 to be dislodged from the housing 22. In the combined audible alarm and spray device, the alarm can be automatically or manually actuated and the spray device is manually actuated and automatically disarmed. The self-defense device may be constructed with only the siren or only the spray device in the housing.

Figures 3, 4, 5, 6:
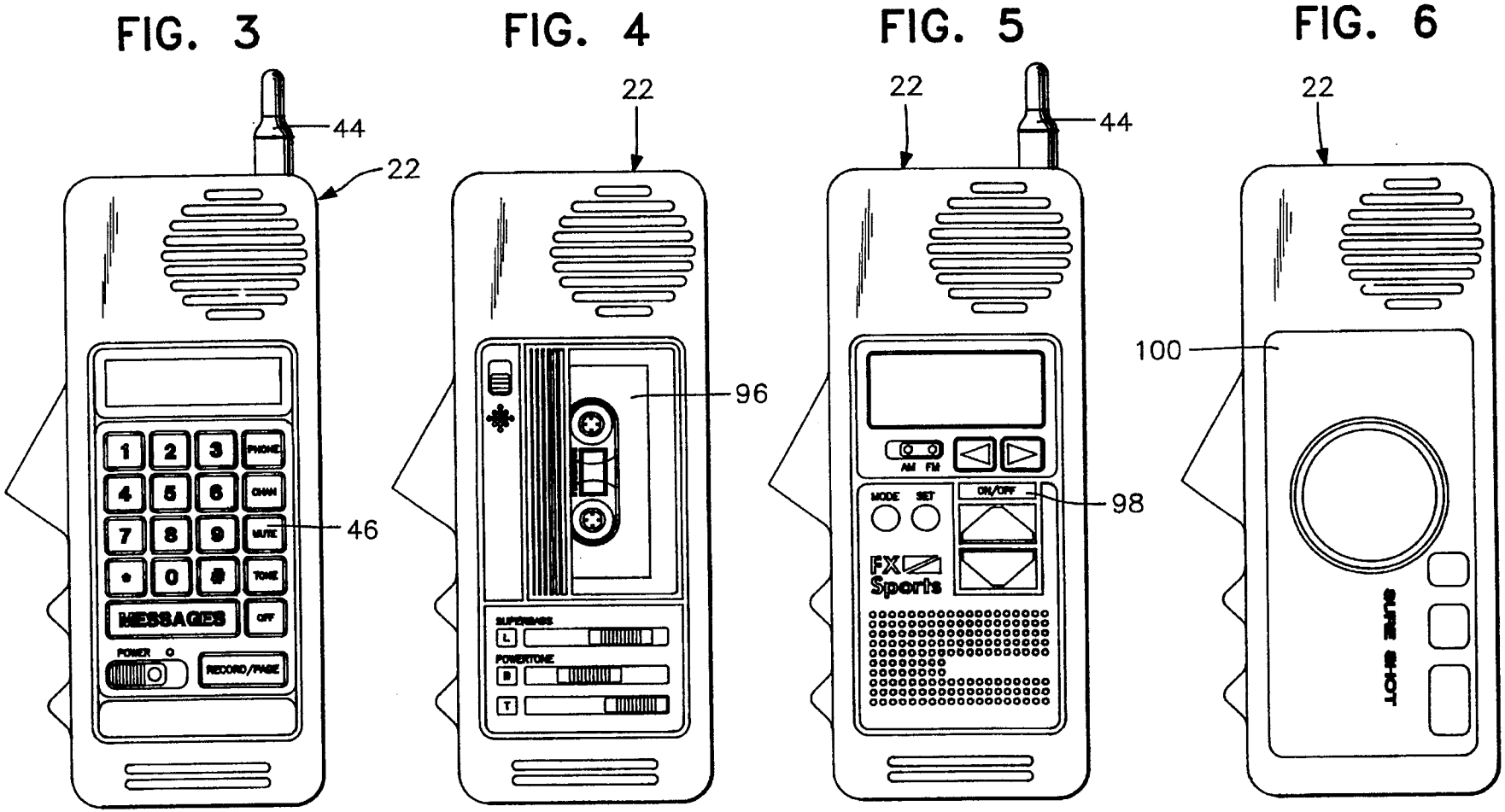
FIGS. 3–6 are front elevational views of the device illustrating the appearance characteristics which simulate a well known hand carried object in the form of a cellular phone, tape recorder, sports radio and camera respectively.

FIG. 3 illustrates in more detail indicia 46 which may be in the form of a preprinted adhesively attached label closely simulating the key pad of a cellular telephone. A purchaser of the device may be provided with optionally used labels such as the label illustrated in FIG. 4 in which the indicia 96 simulates a tape recorder, the label with indicia 98 in FIG. 5 simulating a sports radio or the label with indicia 100 in FIG. 6 simulating a camera. These devices would normally be carried in a hand held position by a person who may be jogging, walking, returning through a parking lot to an automobile after shopping and would not arouse the suspicion of a potential attacker observing that person. This function provides the intended victim with a significant surprise to the attacker by the unexpected extremely loud audible siren or a disabling spray being directed into the facial area of the attacker.

Figures 7, 8, 9, 10:
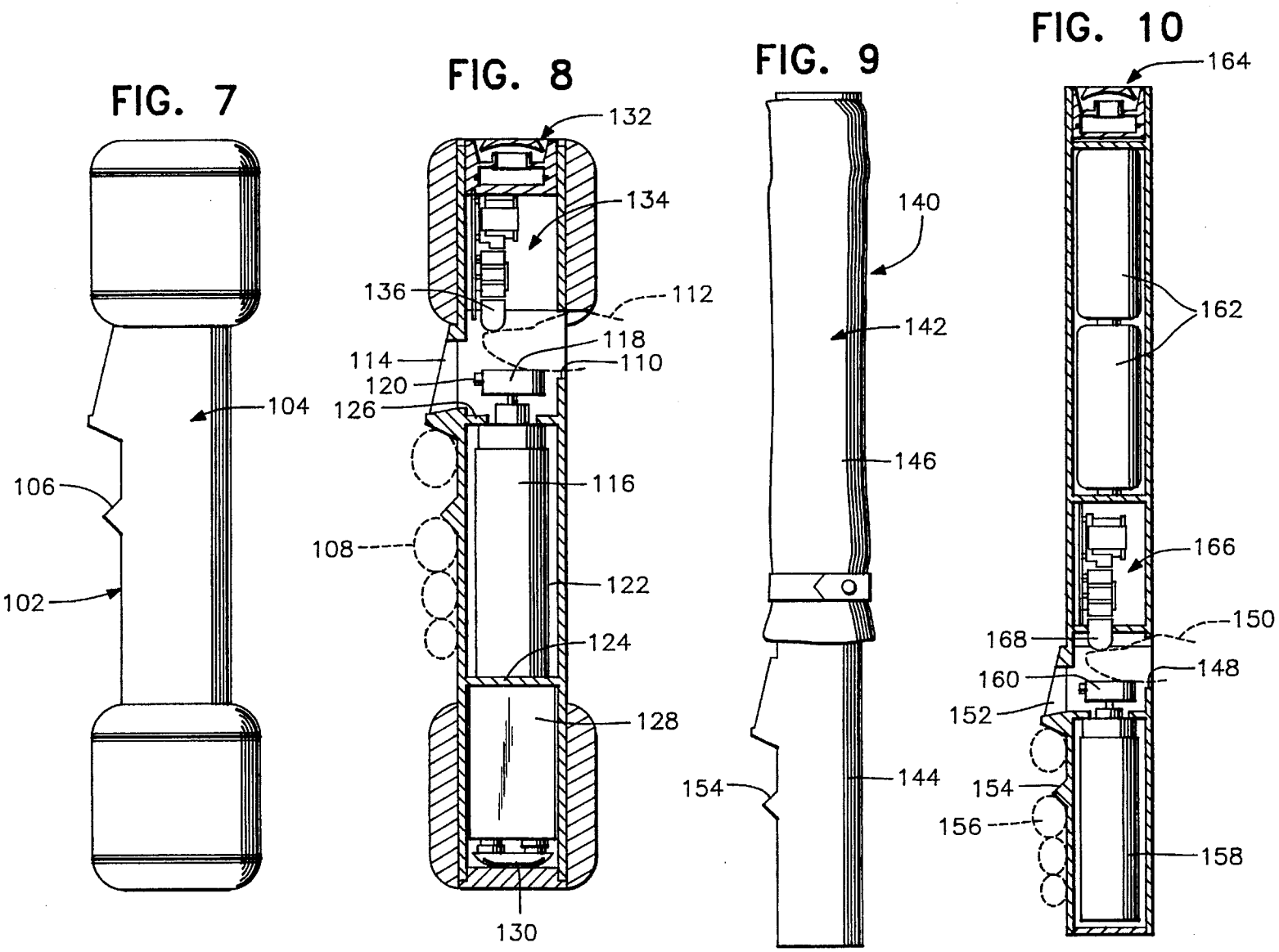
FIG. 7 is an elevational view of an embodiment of the invention in the form of a hand weight.
FIG. 8 is a vertical sectional view of the device of FIG. 7.
FIG. 9 is an elevational view of an embodiment of the invention in the form of a folded umbrella.
FIG. 10 is a vertical sectional view of the device of FIG. 9.

FIGS. 7 and 8 illustrate an embodiment of the self-defense device designated by reference numeral 102 in which the housing 104 is in the shape and configuration of a hand weight or dumbbell. This device is generally of cylindrical configuration and provided with indentations 106 to receive the fingers 108 and an opening 110 for receiving the thumb or finger 112 and an opening 114 generally aligned therewith for discharge of a spray from a canister 116. The canister 116 includes a spray actuating button 118 and a discharge nozzle 120 aligned with and directed toward the opening 114. The canister 116 is supported in an interior space 122 in housing 104 and is supported at its bottom by a transverse wall 124 and engaged at its top by a partial transverse wall 126. This enables the thumb or finger 112 to be inserted through the opening 110 to depress the actuator 118 for discharging disabling spray through the opening 114. The end of the housing 104 outwardly of the partition wall 124 receives a battery 128 having a connector 130 electrically connected to a siren assembly 132 through a push button switch assembly 134. Switch assembly 134 includes a vertically moveable push button 136 located above and aligned with the actuator 118 in order for the thumb or finger 112 to manually engage the push button 136 and actuate the siren. In this construction, both the spray dispensing device and the siren are manually actuated and are independently actuated or simultaneously actuated if desired. This type of independent manual actuation or simultaneous manual actuation can also be incorporated into structures in which the housing is constructed in accordance with FIGS. 1–6.

FIGS. 9 and 10 disclose an embodiment of the self-defense device 140 in which the housing 142 is in the form a folded umbrella having a handle portion 144 and a canopy portion 146 which may be a flexible fabric cover member. The housing 142 is generally cylindrical in configuration and in one end thereof, an opening 148 is provided to receive the thumb or finger 150 with the opposite side having an opening 152 for discharge of disabling spray. Below the opening 152, projections 154 are provided on housing 142 for receiving the fingers 156 as illustrated in FIG. 10. A pressurized spray canister 158 is positioned in the hollow lower end of the housing 142 and includes an actuator 160 to be engaged by the thumb 150 inserted through the opening 148 so that depression of the actuator 160 discharges disabling spray through the opening 152. The other end of the housing 146 includes batteries 162 electrically connected to a siren assembly 164 through a vertically disposed switch assembly 166 having a vertically moveable actuator button 168 engageable by the thumb 150 in the same manner as in FIG. 8. Thus, the intended victim would merely carry the simulated umbrella in a normal hand held position and actuate the siren which would startle and surprise the attacker and possibly cause the attacker to leave the area. If the attacker continued to approach the intended victim, then the disabling spray actuator could be manually actuated to discharge a disabling spray into the facial area of the attacker to temporarily disable the attacker and enable the intended victim to leave the area.

In the embodiments illustrated in FIGS. 1–6, the rear panel 42 is provided with a window 43 in the form of an opening which enables visual observation of the upper end portion of the spray canister 66 which is provided with an identifying color coded band 67 thereon which is visible through the window. This provides an indication of the type of disabling spray that has been loaded into the canister 66 thus indicating to the user the type of spray available for use against a potential attacker.

One of the significant advantages of the self-defense device of this invention is the capability of the device not being easily and immediately recognized as a self-defense device in order that the device can be carried and hand held in public without arousing suspicion and without revealing the fact that a person has a self-defense device immediately available for use. If a self-defense device is immediately recognizable, it could cause possible embarrassment to the owner which might deter the owner from carrying the device in public and cause the owner to leave the device at home. Also, easy recognization enables a potential attacker to benefit from such advance knowledge thereby allowing the attacker to adjust tactics of attack such as by initially trying to obtain possession of the self-defense device. The self-defense device disguised as in the present invention so it can be carried and hand held in public without arousing suspicion and without anyone recognizing the device as a self-defense device is advantageous because potential attackers would not know that the owner was equipped with a self-defense device. Therefore, use of the device would come as complete surprise to the attacker thereby providing a significant tactical advantage to the intended victim. Known spray devices which have been incorporated into a writing pen or flashlight do not provide a disguise of this type since neither of them could be held in a person's hand in public without arousing suspicion since it would be odd to onlookers to see a person walking in public with a pen hand held at the ready or with a hand held flashlight in daylight or when not in use at night. While small sirens, generally referred to as personal alarms, have been used and emit a shrill sound to draw attention and possibly bring help, they are readily recognized as an alarm device. In this invention, the siren is incorporated into a housing that has the appearance characteristics of an easily recognizable object that is normally hand carried. Also, the siren can be combined with the disabling spray device. In case of an imminent attack, the siren may deter the attacker and make the ultimate use of the spray unnecessary. Also, the combination device may include a housing which simulates a well known hand held object to disguise the self-defense device.

The location of the spray actuator prevents accidental operation and discharge of the spray due to the outer shell of the housing having an opening into which the thumb or finger is inserted for operation of the spray actuator. Thus, the spray actuator is largely inaccessible when held in the hand or when touching adjacent objects such as when carrying the device in a purse or pocket thereby substantially preventing accidental triggering of the spray device. The window to enable observation of the spray canister enables the active substance, such as tear gas, pepper solution and the like to be identified as well as a canister containing harmless water base substances. Water based sprays are generally termed as training sprays which enables a person to practice use of the device so that under emergency conditions, the use of the device will be quick and accurate by the user being familiar with the operation of the device. This structure promotes safe handling of the noxious sprays as well as more effective use of the device.

The pepper spray is a full strength formula with a 10% concentration of oleoresin capsicum of sufficient quantity to provide ten to twelve half second bursts of eight to ten foot spray range. The disabling effect lasts up to thirty minutes with the propellant being nontoxic, 100% natural organic and ozone friendly. The siren is a piezo siren emitting 130 decibels which draws attention which an attacker does not want and can be actuated with the tip of the thumb or finger on an internal push button or can be actuated automatically should the self-defense device be pulled from the owner. The self-defense device is disguised in a manner that it can be comfortably carried in plain sight without arousing attention or suspicion thereby enabling total surprise when the spray or siren is used. The battery for the siren is preferably a nine volt alkaline battery and the pin tethered to the wrist strap not only automatically operates the siren but also automatically disarms the spray device if the self-defense device is pulled from the owner. The automatic actuation of the siren and the disarming of the spray device is corrected when the pin is reinserted which requires the use of an inserted thin object such as the end of a paper clip 170 through a hole 172 in the bottom of the housing 22 to lift the spray canister 66 upwardly against the bias of the spring 70. The housing may be constructed of molded plastic material, metal or the like and is preferable black to simulate the well known objects depicted in the drawings or other well known objects that could be hand held or carried without arousing suspicion.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A self-defense device comprising a housing having an exterior shape and appearance simulative of a well known object that would not arouse suspicion when carried in public in a hand held position, said housing including a hollow interior portion receiving a self-defense apparatus, said self-defense apparatus having an actuator within the interior of the housing, said housing including an access opening continuously accessing said actuator to enable actuation of the self-defense apparatus by a user to the surprise of a potential attacker.

2. The self-defense device as defined in claim 1 wherein said self-defense apparatus is in the form of a siren having a high decibel output, battery means in the housing for supplying electrical energy, a first switch means within the housing and interconnecting the battery and siren, said actuator including an actuator button of said first switch means positioned in relation to the opening to enable access of the thumb or finger of a user to the button for closing said first switch means for actuating the siren.

3. The self-defense device as defined in claim 1 wherein said self-defense apparatus is a siren, said housing including a battery for supplying electrical energy and switch means interconnecting the battery and siren, said actuator including means for tethering to the wrist area of a user to be removed if the self-defense device is taken away from the user to close said switch means thereby automatically actuating said siren.

4. The self-defense device as defined in claim 2 together with a second switch means independent of said first switch means actuator for, said second switch means including an actuating member for tethering to a user to actuate the second switch means to automatically operate the siren when the self-defense device is pulled away from the wrist of the user.

5. The self-defense device as defined in claim 1 wherein said self-defense apparatus includes a pressurized canister of disabling spray, said actuator being accessible to a user's finger through the opening in the housing for manual actuation of the actuator, said actuator including a discharge nozzle, said housing including a spray discharge opening aligned with the discharge nozzle and facing away from the access opening for discharge of disabling spray from the nozzle through the discharge opening, said actuator being located within the interior of the housing to prevent accidental triggering of the actuator, said housing and actuator including means to prevent rotation of the actuator to maintain the spray nozzle in alignment with the discharge opening.

6. The self-defense device of claim 5 together with means incorporated into the housing to disarm the spray actuator and nozzle when the housing is pulled away from the hand and wrist area of a user.

7. The self-defense device as defined in claim 6 wherein said means for disarming the spray actuator and nozzle includes a pin supportingly engaging one end of the spray canister, said pin being removable to release the spray canister to enable the spray canister to move in relation to the access opening to a position in which the actuator is engaged with the housing thereby preventing the actuator from being operated while the pin is removed from the housing.

8. The self-defense device as defined in claim 7 wherein said self-defense apparatus within the housing also includes a siren having a high decibel output, battery means in the housing for supplying electrical energy, first switch means in the housing interconnecting the battery and siren, said actuator including an actuator button positioned in relation to the access opening to enable access of the thumb or finger of a user to the actuator button for manually actuating the siren independent of discharge of disabling spray from the canister.

9. The self-defense device as defined in claim 7 wherein said self-defense apparatus also includes a siren, said housing including a battery for supplying electrical energy and switch means interconnecting the battery and siren, said switch means being actuated when said pin is removed, said pin being tethered to a user and removed if the self-defense device is taken away from the user thereby automatically actuating said siren and preventing operation of said spray actuator.

10. The self-defense device as defined in claim 8 together with second switch means independent of said first switch means, said actuator for said second switch means including an actuating member tethered to a user to actuate said second switch means to automatically operate the siren when the self-defense device is pulled away from the user.

11. A self-defense device comprising (a) a housing having an exterior shape and appearance simulative of a well-known object that would not arouse suspicion when carried in public by a user in a handheld position, a generally hollow interior and an access opening therein to enable access of a thumb or finger of said user into the housing interior; (b) siren means mounted within said housing interior and actuatable through said access opening by the user; and (c) a disabling spray apparatus mounted within said housing interior and also actuated through said access opening by the user.

12. The self-defense device as defined in claim 11 and further including an actuator means for automatically actuating said siren means and automatically disabling said disabling spray apparatus if the self-defense device is taken away from the user.

13. A self-defense device as defined in claim 12 wherein said actuator means includes tethering means for attachment to the wrist area of the user such that removal of the device from the user disengages the actuator means from said housing and automatically causes actuation of said siren means and disablement of said spray apparatus.

14. The self-defense device as defined in claim 11 wherein said exterior shape and appearance simulates an object selected from a cellular phone, tape recorder, radio, camera, hand weight and folded umbrella.

* * * * *